United States Patent [19]

Watanabe et al.

[11] 4,368,971

[45] Jan. 18, 1983

[54] DEVELOPING DEVICE

[75] Inventors: Tsuyoshi Watanabe; Kimio Nakahata, both of Kawasaki; Fumitaka Kan, Tokyo; Masaaki Sakurai, Hanno, all of Japan

[73] Assignee: Canon Kabushiki Kaisha, Tokyo, Japan

[21] Appl. No.: 308,084

[22] Filed: Oct. 2, 1981

[30] Foreign Application Priority Data

Oct. 9, 1980 [JP] Japan ..... 55-141184

[51] Int. Cl.[3] ..... G03G 15/00

[52] U.S. Cl. ..... 355/3 DD; 355/14 D; 355/3 R; 118/657; 118/658; 118/651

[58] Field of Search ..... 355/3 DD, 14 D, 3 R; 118/657, 658, 661, 651; 430/120

[56] References Cited

U.S. PATENT DOCUMENTS

| | | | |
|---|---|---|---|
| 3,863,603 | 2/1975 | Buckley et al. | 355/3 DD X |
| 3,998,185 | 12/1976 | Weiler | 355/3 DD X |
| 4,282,303 | 8/1981 | Bergen | 430/120 |
| 4,289,837 | 9/1981 | Gundlach | 430/120 X |
| 4,318,606 | 3/1982 | Buholtz et al. | 118/657 X |
| 4,331,754 | 5/1982 | Stephan | 355/3 DD X |

*Primary Examiner*—A. C. Prescott

*Attorney, Agent, or Firm*—Fitzpatrick, Cella, Harper & Scinto

[57] ABSTRACT

In a dry type developing device having a magnetic field producing means, nonmagnetic developer supporting means, means for moving said magnetic field producing means and said nonmagnetic developer supporting means relative to each other, and means for supplying developer to that side of the nonmagnetic developer supporting means which is opposite to the magnetic field producing means, the surface of the nonmagnetic developer supporting means which is adjacent to the developer supply means is provided with plating containing grains therein.

6 Claims, 8 Drawing Figures

FIG. 4
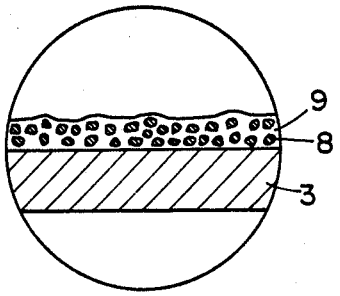
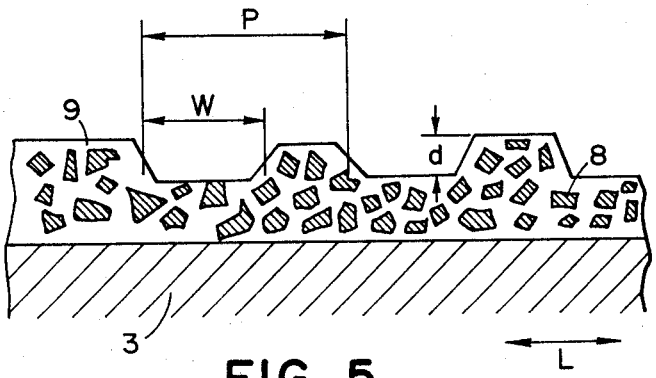
FIG. 5
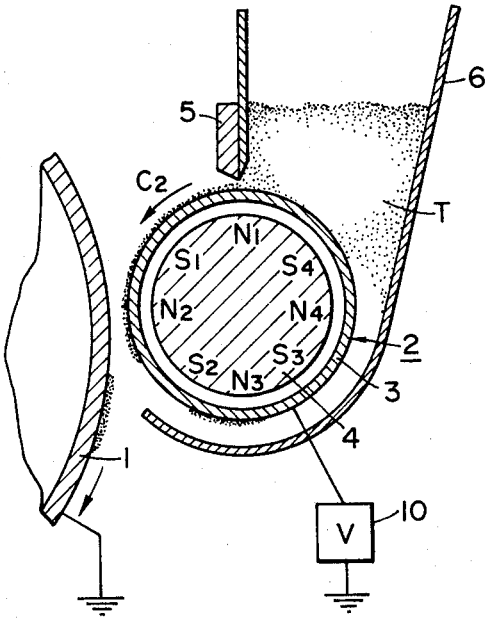
FIG. 6

DEVELOPING DEVICE

BACKGROUND OF THE INVENTION

1. Field of the Invention

This invention relates to a dry type developing device for use in an image formation apparatus using the electrophotographic method or the like.

2. Description of the Prior Art

FIG. 1 of the accompanying drawings schematically shows a dry type developing device according to the prior art. A hopper-shaped container 6 for storing developer therein has an upper lid 11 which can be opened and closed so that fresh developer may be supplied thereinto whenever required. In the lower opening of the container 6, there is provided a developing roller 2 having a magnet roller 4 disposed in a cylindrical nonmagnetic developer supporting member 3 (hereinafter referred to as a sleeve). The sleeve 3 and the magnet roller 4 can be driven independently of each other and therefore, if the magnet roller 4 is fixed and the sleeve 3 is rotated in counter-clockwise direction $C_2$ or both are rotated but the speed of rotation of the sleeve in the direction $C_2$ is somewhat higher than the speed of rotation of the magnet roller 4 in clockwise direction $C_1$, then the developer sticking to the sleeve 3 can be conveyed toward a latent image bearing member. The developer, when conveyed out of the container 6, is formed into a thin layer by a blade 5 secured to the container 6. As a result, in the developing station D, the developer on the sleeve 3 adheres to the latent image bearing member 1 in accordance with the charge possessed by the latent image thereon, whereby the latent image is developed and visualized in accordance with each color tone.

However, in the above-described dry type developing device according to the prior art, when foreign substances enter into the developing device, the surface of the sleeve 3 may be scratched or locally abraded by the foreign substances, so that a uniformly thin layer of developer cannot be held on the sleeve 3 or the life of the sleeve 3 is remarkably shortened, thus making it difficult to obtain images of good quality.

In some cases, a uniform rough surface is provided on the sleeve by machining in order to improve the developer conveying characteristic of the sleeve. The assignee of the present invention has previously proposed a method of forming a rough surface on the sleeve in copending U.S. application Ser. No. 138,909. However, as the wear of such rough surface progresses, the conveying characteristic of the sleeve is reduced. As a result, the developer conveyed from the container 6 onto the sleeve, as shown in FIG. 2 on the accompanying drawings, creates lumps B due to the developer A swelling out from the tip end of the blade 5, and this has led to the disadvantage that irregularity of development or the like is caused.

SUMMARY OF THE INVENTION

It is an object of the present invention to eliminate the above-noted disadvantages peculiar to the prior art and to provide a dry type developing device which can always provide images of good quality.

It is another object of the present invention to provide a developing device in which the wear proof of the surface of developer supporting means is improved and the developer conveying characteristic thereof is enhanced.

The present invention hardens the sleeve of a developing roller by plating containing grains therein to thereby improve the wear proof of the sleeve. That is, the gist of the present invention consists in a dry type developing device having magnetic field producing means, nonmagnetic developer supporting means, means for moving the magnetic field producing means and the nonmagnetic developer supporting means relative to each other, and means for supplying developer to that side of the nonmagnetic developer supporting means which is opposite to the magnetic field producing means, characterized in that the surface of the nonmagnetic developer supporting means which is adjacent to the developer supply means is provided with plating containing grains therein.

According to a recommended embodiment of the present invention, there is provided a developing device in which the surface of the nonmagnetic developer supporting means which is adjacent to the developer supply means is provided with plating containing grains therein and wherein the surface roughness pitch is $5\mu$–$100\mu$, the depth of the valleys is $0.5\mu$–$8\mu$ and the width of the valleys is $0.05\mu$–$24\mu$.

The above and other objects and features of the present invention will become more fully apparent from the following detailed description taken in conjunction with the accompanying drawings.

BRIEF DESCRIPTION OF THE DRAWINGS

FIG. 4 is an enlarged cross-sectional view of the sleeve. FIG. 5 is a schematic view showing a recommended working pattern of the plated surface of the sleeve according to the present invention.

FIG. 6 is a cross-sectional view of the developing device according to an embodiment of the present invention.

DESCRIPTION OF THE PREFERRED EMBODIMENTS

Embodiments of the present invention will hereinafter be described by reference to the drawings.

Figure 1:
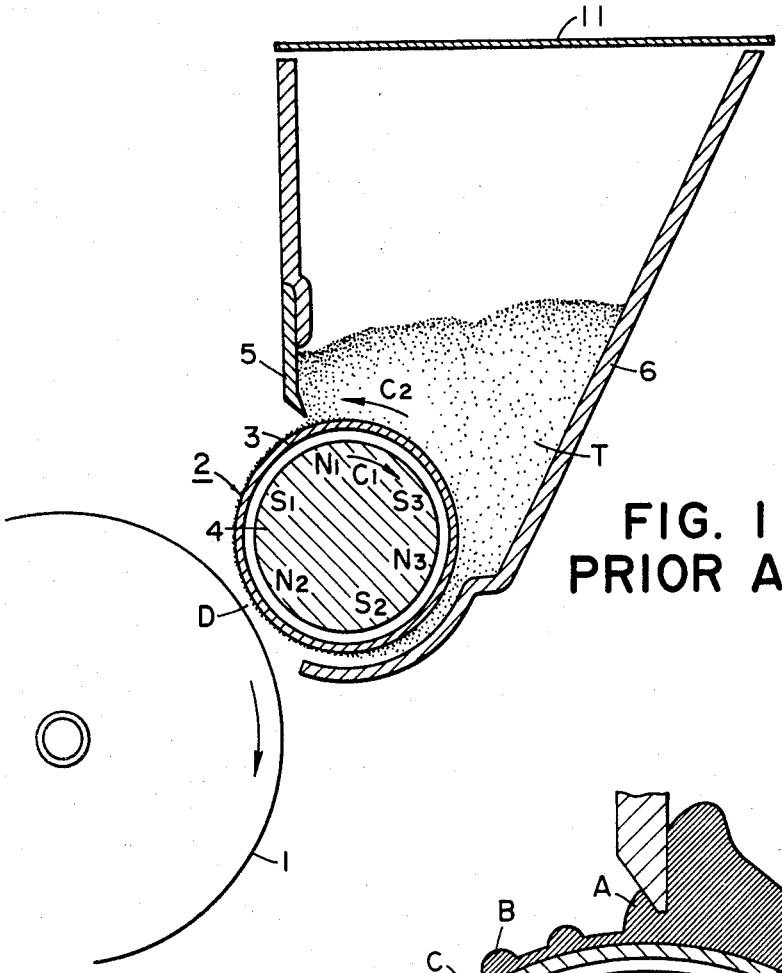
FIG. 1 PRIOR ART
FIG. 1 is a transverse cross-sectional view of the dry type developing device according to the prior art.
Figure 2:
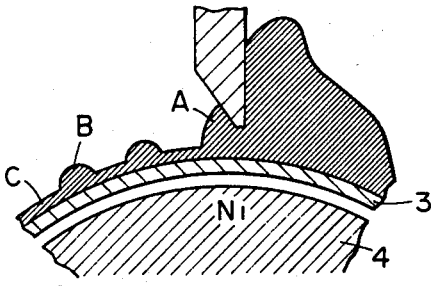
FIG. 2 PRIOR ART
FIG. 2 shows the manner in which the developer on the sleeve is controlled by a blade.
Figure 3:
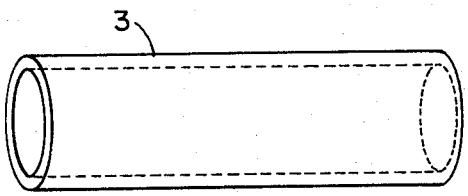
FIG. 3 is a perspective view of a sleeve according to the present invention.

FIG. 3 shows the appearance of the sleeve 3 according to the present invention, and FIG. 4 is an enlarged cross-sectional view thereof. The surface of the sleeve 3 formed of stainless steel, for example, is provided with plating 9 containing fine grains 8.

The table below shows an embodiment in which the surface of the sleeve has been plated on the basis of the present invention. All of the material of the sleeve, SuS 304 and aluminum (A1) have been greatly improved in hardness Hv (Hv: Vickers' hardness (JISZ2244–1976)) after the plating treatment. The hardness is attributable to the contribution of the grains contained in the plating, but differs depending on the particle diameter of the grains, the concentration of the plating liquid, the type of the grains, etc. However, according to the present experiment, it has been found that for Hv<500, sufficient wear proof is not provided and for Hv>1500, wear proof is provided but shock resistance is reduced, and it has become clear that hardness Hv=500–1500 is suitable. The hardness can be improved by heat treatment (300°–400° C.), but the result of the heat treatment after the plating treatment is as shown in the table above, that is, SuS 304 has presented Hv=1300 which is 1.3 times as high as the hardness before the heat treatment. According to the present embodiment, a sleeve of high wear proof and shock resistance could be obtained by the use of a conventional material. The plating liquid is not restricted to nickel, but copper or silver is also usable as the plating liquid.

TABLE

Embodiments of the Plating Treatment of the Present Invention

| Specification | Embodiments 1 | Embodiments 2 |
|---|---|---|
| Material of the sleeve | SuS 304 | Al |
| Plating liquid | Nickel | |
| Grains | SiC | $Al_2O_3$ |
| Hardness (Hv) | | |
| Before plating | 300 | 100 |
| After plating | 1000 | 800 |
| After heat treatment | 1300 | — |

Now, as mentioned previously, in some cases, the sleeve is provided with a rough surface of predetermined regularity to improve its developer conveying characteristic, and this has been accomplished chiefly by machining. However, the plated surface on the sleeve according to the present invention permits the formation of a rough surface by grains and can improve the aforementioned conveying characteristic without using the machining. As regards the grains used, if the particle diameter D thereof is $D<0.1\mu$, the effect of improving the hardness will be small and if $D>350\mu$, it will be difficult to wrap the grains in the plating liquid. Accordingly, a recommendable particle diameter of the grains is in the range of $0.1–350\mu$. The grains are not restricted to SiC and $Al_2O_3$ given in the table above, but C, $Fe_2O_3$, $TiO_2$, TiC, etc. may be used singly or in combination to improve the hardness. FIG. 5 shows the appearance of the recommendable working pattern by a plating treatment in a one-component developing system (a system) in which only developer particles are conveyed for use in the development.

According to the present experiment, it has been possible to obtain a good conveying effect when the pitch P in the lengthwise direction L of the sleeve is $P=5\mu–100\mu$ and the depth d of the valleys is $d=0.05\mu–8\mu$ and the width W of the valleys is $W=d-3d$. That is, for $P<5\mu$, the developer conveying characteristic is not good and for $P>100\mu$, the sleeve surface is too rough and provides a hindrance to the image formation. Also, for $d<0.05\mu$, the particle diameter of the grains is smaller than the particle diameter of the developer and no conveying effect is provided and, for $d>8\mu$, the developer stagnates in the valleys. For $W<d$, no conveying effect is provided and for $W>3d$, the conveying effect again becomes null.

FIG. 6 shows an embodiment of the jumping developing system (U.S. applications Ser. Nos. 58,434 and 58,435 by the assignee of the present invention) of the dry type developing device according to the present invention. In FIG. 6, a photosensitive drum 1 which is an image bearing member is grounded and rotated in the direction of arrow. A sleeve 2 is rotated in the direction of arrow $C_2$, and a fixed magnet roller 4 is disposed in the sleeve 2. The magnet roller 4 has a developing magnetic pole $N_2$ in the developing area and has a magnetic pole $N_1$ at a position opposed to a blade 5 formed of a magnetic material. A hopper 6 supplies one-component magnet toner T to the sleeve 3, and the supplied toner T is controlled to a layer thickness thinner than the gap between the sleeve 3 and the magnetic blade 5 by a magnetic field present between the magnetic blade 5 and the magnetic pole $N_1$. The controlled toner layer thickness is thinner than the spacing between the sleeve 3 and the photosensitive drum 1. An AC voltage having a DC voltage superposed thereon is applied to the sleeve 3 by a power source 10 so that an alternate electric field is formed between the sleeve 3 and the drum 1. The magnetic toner on the sleeve 2 is caused to reciprocate between the sleeve and the drum by the alternate electric field, whereby there is obtained a fog-free, highly harmonious developed image.

Figure 7:
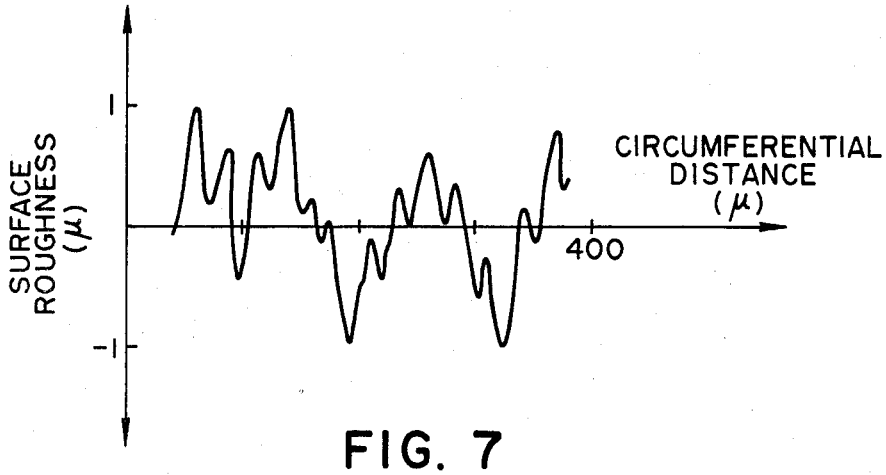
FIG. 7 is a graph showing the measurement result of the surface roughness of the developing roller in the device of FIG. 6.
Figure 8:
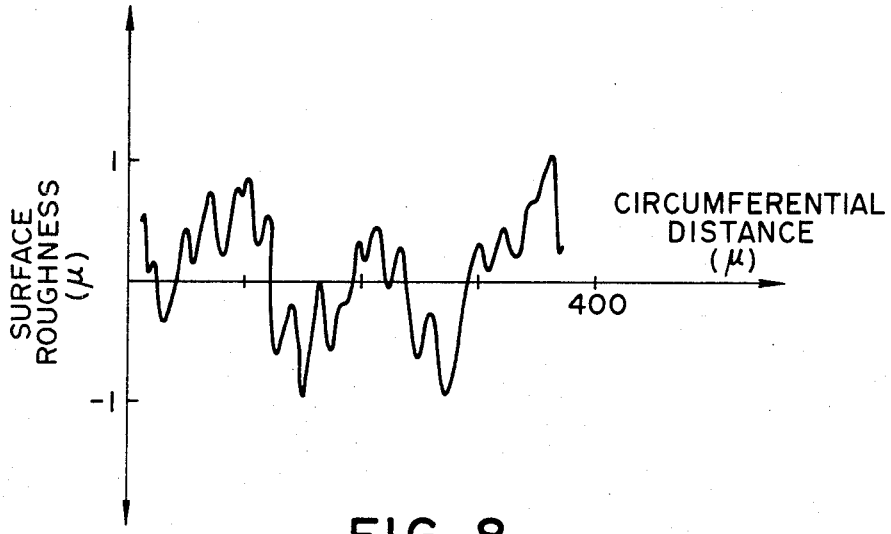
FIG. 8 is a graph showing the measurement result of the roughness after 300 hours of continuous copying.

Now, the sleeve 3 having SuS 304 formed thereon is provided with plating of thickness $30\mu$ by SiC grains of particle diameter $10\mu$ and nickel liquid. FIG. 7 shows the measurement result of the surface roughness of the sleeve in the above-described device after the plating treatment, and FIG. 8 shows the measurement result also of the surface roughness of the sleeve after about 300 hours of continuous copying. In these Figures, the horizontal axis represents the movement distance ($\mu$) on the circumference resulting from the rotation $C_2$ of the sleeve, and the vertical axis represents the surface roughness ($\mu$) of the sleeve. As can be seen from these results, the roughness before and after the continuous copying has been $\pm 1\mu$ or so which means only a slight difference, and little or no wear has occurred. According to the present embodiment, there can be provided a dry type developing device which has a developing roller 2 of high wear proof and in which the developer conveying force is not reduced and over- or under-development and irregularity of development are not caused.

The present invention is not always restricted to the above-described embodiment but is also successfully applicable to other dry type developing devices.

According to the present invention, the surface of the developer supporting member is treated by plating containing grains therein, whereby the hardness of that member is increased to improve the wear proof thereof, and this leads to the provision of a dry type developing device which ensures stable conveyance of developer and accordingly can provide images of good quality.

What we claim is:

1. A developing device for forming a developed image on an image bearing member, said device comprising:

developer supporting means formed of a nonmagnetic material and having a surface for receipt and conveyance of developer thereon;

magnetic field producing means surrounded by said developer supporting means; and means for supplying developer to said developer supporting means, wherein the developer conveying surface of said developer supporting means is positioned adjacent to said developer supply means and is provided with plating containing grains therein.

2. A developing device according to claim 1, wherein surface roughness of the surface of said developer supporting means after said plating treatment is such that its pitch is 5μ–100μ, its depth of valleys is 0.05μ–8μ, and its width of valleys is 0.05μ–24μ.

3. A developing device according to claim 1, wherein said developer supporting means after the plating treatment is subjected to a heat treatment.

4. A developing device according to any of claims 1 to 3, wherein the Vickers' hardness of the surface of said developer supporting means is Hv=500–1500.

5. A developing device according to claim 1, wherein the particle diameter of said grains is D=0.1–350μ.

6. A developing device according to claim 1 or 5, wherein said grains are $Al_2O_3$, $Fe_2O_3$, $TiO_3$ or TiC or a mixture thereof.

* * * * *